US006481498B1

(12) United States Patent
Ackroyd et al.

(10) Patent No.: US 6,481,498 B1
(45) Date of Patent: Nov. 19, 2002

(54) SLIP CONNECTOR FOR USE WITH COILED TUBING

(75) Inventors: Warren Ackroyd, Poole Dorset (GB); Robert Parker, Dorset (GB)

(73) Assignee: Tuboscope I/P, Houston, TX (US)

( * ) Notice: Subject to any disclaimer, the term of this patent is extended or adjusted under 35 U.S.C. 154(b) by 5 days.

(21) Appl. No.: 09/729,962

(22) Filed: Dec. 7, 2000

(51) Int. Cl.[7] ..... E21B 23/00; F16L 21/06
(52) U.S. Cl. ..... 166/242.6; 285/125.3
(58) Field of Search ..... 285/125.3; 166/380, 166/242.6; 175/423

(56) References Cited

U.S. PATENT DOCUMENTS

| | | | | |
|---|---|---|---|---|
| 4,711,326 A | | 12/1987 | Baugh et al. | |
| 4,750,559 A | | 6/1988 | Greenlee et al. | |
| 4,825,954 A | | 5/1989 | Baugh | |
| 5,215,151 A | | 6/1993 | Smith et al. | |
| 5,306,050 A | | 4/1994 | Laflin et al. | |
| 5,452,923 A | * | 9/1995 | Smith | 285/145 |
| 5,524,937 A | * | 6/1996 | Sides, III et al. | 285/133.1 |
| 5,944,102 A | * | 8/1999 | Kilgore et al. | 166/119 |
| 5,988,702 A | * | 11/1999 | Sas-Jaworsky | 285/249 |
| 6,209,652 B1 | * | 4/2001 | Portman et al. | 166/379 |
| 6,250,393 B1 | * | 6/2001 | Mackenzie et al. | 166/380 |
| 6,338,504 B1 | * | 1/2002 | Hilliard | 285/3 |

* cited by examiner

*Primary Examiner*—William Neuder
(74) *Attorney, Agent, or Firm*—Finnegan, Henderson, Farabow, Garrett & Dunner LLP

(57) ABSTRACT

A coiled tubing slip connector for connection to the end of coiled tubing to be inserted into a well bore. The connector provides both rigid connection to withstand impact and torsional forces encountered within a well bore and yet permits disconnection from the tubing without damaging the connector. Hence, the connector may be reused.

3 Claims, 3 Drawing Sheets

SLIP CONNECTOR FOR USE WITH COILED TUBING

BACKGROUND OF THE INVENTION

The invention relates to a coiled tubing slip connector for connection to the end of coiled tubings inserted into a well bore.

In oil drilling applications, tubing is fed from a coil thereof into the well bore as a means for transporting into the well bore various tools and data-gathering devices. These tools are attached to the end of the coiled tubing prior to insertion thereof into the well bore by means of connectors that are secured to the end of the tubing and which in turn are connected to the tooling or data-gathering devices to be inserted into the well bore.

It is desirable to have connectors of this type that may both be firmly secured to the coiled tubing sufficient that they can withstand severe impact without becoming disconnected, while providing for ease of disconnection and use upon withdrawal thereof from the well bore. With prior art connectors conventionally used for this purpose, achieving this desired combination cannot be obtained.

SUMMARY OF THE INVENTION

It is accordingly a primary object of the present invention to provide a coiled tubing slip connector that provides both rigid connection to withstand impact and torsional forces typically encountered in insertion within a well bore and yet when The coiled tubing slip connector in accordance with the invention provides bearing means that are positioned on the tubing for supporting the tubing concentrically within the bearing means. In addition, the bearing means have an internal annular bearing surface.

Support means are positioned between the bearing means and the tubing and have an internal surface portion in supporting contact with an external surface portion of the tubing. An end portion of the support means is in bearing contact with the annular bearing surface of the bearing means. The support means has an annular, internal bearing surface.

Securing means are provided for tightly securing the tubing to the connector and include an end thereof in bearing contact with the annular, internal bearing surface of the support means and having in addition an internal threaded body portion with the first series of threads extending in one direction and a second series of threads extending in an opposite direction. With this structure, the threaded body portion is in wedged connection between the support means and an exterior portion of the tubing The annular, internal bearing surface of the support means terminates at the internal surface portion of the support means that is in supporting contact with the external surface portion of the tubing.

The connector further includes engaging means having a rotatable connector portion for selective connection to an end of the securing means opposite the end thereof in bearing contact with the annular, internal bearing surface of the support means.

The rotatable connector portion of the engaging means may further include a recessed end portion for selective connection to a tang on the end of the securing means opposite the end thereof in bearing contact with the annular, internal bearing surface of the support means. The engaging means may further include an external, annular, radial extension in engagement with an end of the bearing means.

DETAILED DESCRIPTION OF THE PREFERRED EMBODIMENTS

Figure 1:
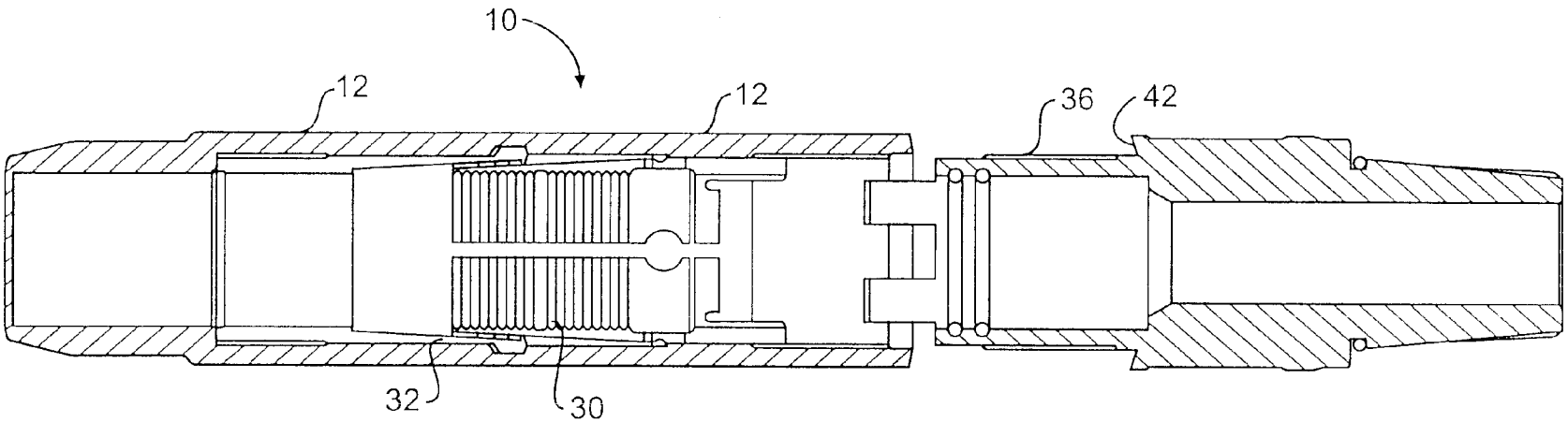
FIG. 1 is an assembly view in vertical cross section of one embodiment of the coiled tubing slip connector in accordance with the invention.
Figure 2:
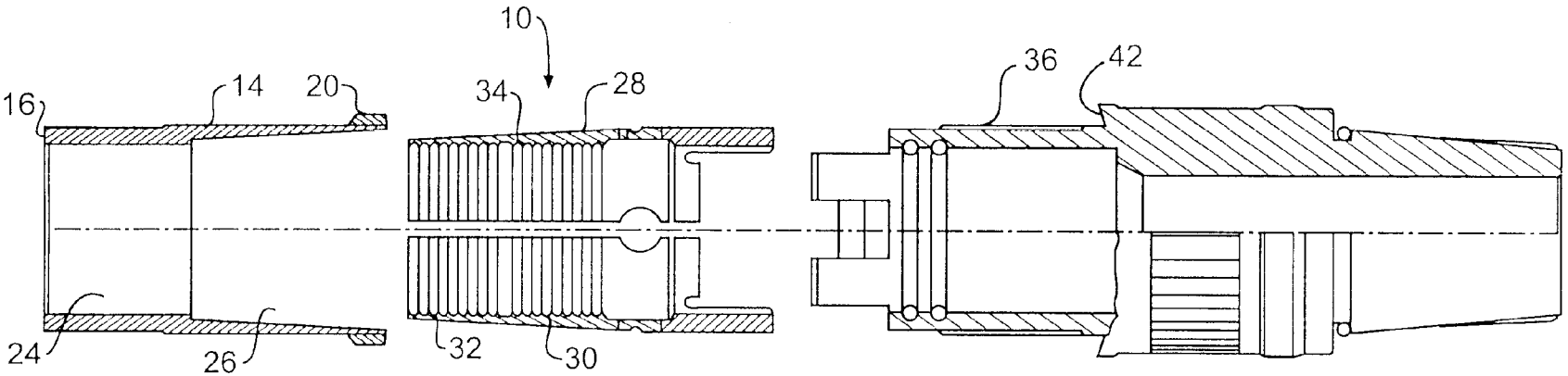
FIG. 2 is an exploded view of the connector of FIG. 1 in vertical cross section.
Figure 3:
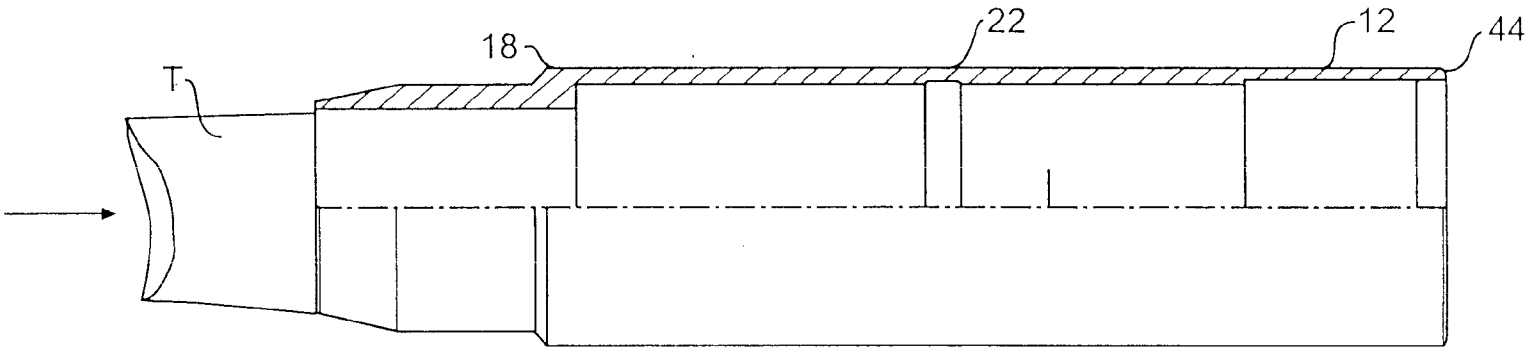
FIG. 3 is a view of the top sub component of the connector.
Figure 4:
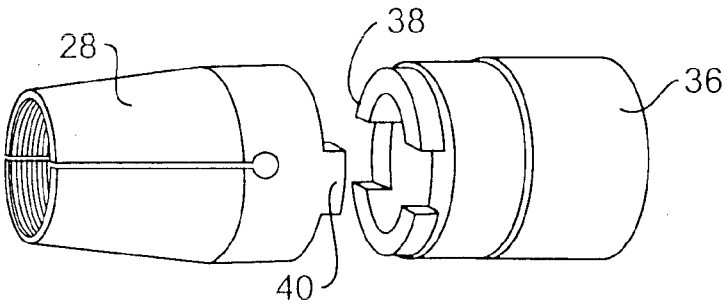
FIG. 4 is a perspective view of the slip and slip bowl of the bottom sub of the connector.

With reference to the drawings, and for the present two FIGS., 1 and 2 thereof, there is shown a slip connector designated generally as 10. The connector includes a top sub 12 through which a coiled tubing T is inserted in the direction of the arrow, as shown in FIG. 3. A slip bowl 14 with a forward end thereof 16 is in bearing contact with a relieved portion 18 of top sub 12. An annular extension 20 of the slip bowl is connected to the top sub within annular relieved area 22 of the top sub, as best shown in FIG. 1. The internal cylindrical surface 24 of the slip bowl 14 is in contact with the outer surface of the tubing T. A tapered internal portion 26 receives slip 28 having a threaded portion 30 tapered to enter the tapered portion 26 of slip bowl 14. The threads are in two portions designated as 32 and 34 which threads of each extend in opposite directions. This provides for secure engagement between the slip 28 and the slip bowl 14. A bottom sub 36, as best shown in FIG. 4, has an annular recessed portion 38 that is adapted to receive tang 40 of slip 28 to permit connection of these components by relative rotational engagement between tang 40 and mating portion 38 of slip 28. Bottom sub 36 also has a raised exterior portion 42 that when in engagement with the slip 28 is contact with end portion 44 of the top sub 12.

In accordance with this embodiment of the invention, the threaded engagement between the slip bowl and the slip with the threads of the slip extending in opposite directions provides for the required rigid connection to withstand impact and torsional separating forces encountered during use of the connector in a well bore. The tang connection between the slip and the bottom sub provides for ease of removal of the connector from the coiled tubing upon removal from the well bore. This is achieved by the simple operation of rotating the tang out of contact with the connector portion 38 of the slip.

In the claims:

1. A coiled tubing slip connector for connection to the end of coiled tubing to be inserted into a well bore comprising:

bearing means positioned on said tubing for supporting said tubing concentrically therein and having an internal annular bearing surface;

support means positioned between said bearing means and said tubing and having an internal surface portion in supporting contact with an external surface portion of said tubing, with an end portion of said support means being in bearing contact with said annular bearing surface of said bearing means, said support means having an annular, internal bearing surface that terminates at said internal surface portion of said support means in supporting contact with said external surface portion of said tubing;

securing means for tightly securing said tubing to said connector and having an end thereof in bearing contact with said annular, internal bearing surface of said support means and having an internal threaded body portion with a first series of threads extending in one direction and a second series of threads extending in an opposite direction to withstand impact and torsional separating forces encountered during use, with said threaded body portion being in wedged connection between said support means and an exterior portion of said tubing; and engaging means having a rotatable connector portion for selective connection to an end of said securing means opposite said end thereof in bearing contact with said annular, internal bearing surface of said support means.

2. The connector of claim 1, wherein said rotatable connector portion of said engaging means include a recessed end portion of said selective connection to a tang on said end of said securing means opposite said end thereof in bearing contact with said annular, internal bearing surface of said support means.

3. The connector of claim 2, wherein said engaging means includes an external, annular radial extension in engagement with an end of said bearing means.

* * * * *